US005468067A

United States Patent [19]

Berkhan et al.

[11] Patent Number: 5,468,067

[45] Date of Patent: Nov. 21, 1995

[54] METHOD FOR MIXING LIQUID MEDIA HAVING DIFFERENT SPECIFIC WEIGHTS

[75] Inventors: Ernst Berkhan, Weinheim; Hubert Muth, Mauer, both of Germany

[73] Assignee: Desaga GmbH, Heidelberg, Germany

[21] Appl. No.: 331,295

[22] Filed: Oct. 28, 1994

Related U.S. Application Data

[63] Continuation of Ser. No. 120,255, Sep. 13, 1993, abandoned.

[30] Foreign Application Priority Data

Sep. 15, 1992 [DE] Germany ..... 42 30 861.5

[51] Int. Cl.[6] ..... B01F 11/00

[52] U.S. Cl. ..... 366/208; 366/213

[58] Field of Search ..... 366/197, 200, 366/204, 208, 209, 210, 211, 213, 214, 219, 220, 235, 348; 494/16, 33

[56] References Cited

U.S. PATENT DOCUMENTS

| | | | |
|---|---|---|---|
| 1,011,929 | 12/1911 | Ecaubert | 366/213 X |
| 1,997,935 | 4/1935 | Johnson | 366/214 |
| 2,165,497 | 7/1939 | Mickelsen | 366/210 X |
| 3,134,578 | 5/1964 | Anderson | 366/235 |
| 3,138,367 | 6/1964 | Raether | 366/235 X |
| 3,387,828 | 6/1968 | Bosche | 366/235 X |
| 3,552,724 | 1/1971 | Thomsen | 366/235 |
| 3,778,033 | 12/1973 | Pullman . | |
| 5,133,208 | 7/1992 | Ricci | 494/16 X |

FOREIGN PATENT DOCUMENTS

| | | | |
|---|---|---|---|
| 2710889 | 9/1978 | Germany . | |
| 837345 | 6/1960 | United Kingdom | 366/235 |

*Primary Examiner*—Charles E. Cooley
*Attorney, Agent, or Firm*—Anderson Kill Olick & Oshinsky

[57] ABSTRACT

Method for mixing a plurality of specimens having different specific weights in an intermittent mixer with a receiving rotor which method includes filling partially at least one elongate container with the specimens, sealing the at least one elongate container, placing the at least one container in the intermittent mixer such that the bottom end of the at least one container contacts the receiving rotor, and rotating the at least one container with a vertical axle while the container is inclined such that the horizontal distance from the bottom end of the at least one container to the rotary axle is less than the distance from the top end of the container to the axle.

3 Claims, 1 Drawing Sheet

METHOD FOR MIXING LIQUID MEDIA HAVING DIFFERENT SPECIFIC WEIGHTS

This is a continuation of application Ser. No. 08/120,255, filed Sep. 13, 1993, now abandoned.

FIELD OF THE INVENTION

The invention deals with a method for mixing of media by rotation, wherein the media have different specific weights and are filled into an elongated closed vessel (tubelet) in such a way that a sufficiently large empty space remains for mixing the specimen or sample.

BACKGROUND OF THE INVENTION

The intermixing of specimens containing light and heavy parts or shares, as the intermixing of suspensions, the re-suspending of blood cells or mixing of blood and anticoagulants after drawing the blood, which are filled in small quantities into elongated vessels such as reaction tubes and—flasks with a small diameter or into cuvettes, is fraught with considerable problems. A gentle and sufficiently thorough intermixing can frequently be achieved only with difficulty in known mixers, as such, that tilt the vessel around its lateral axis or where the vessel rotates around a horizontal longitudinal axis. This is due to the circumstance that progressively smaller quantities of liquid are required and thus correspondingly more narrow vessels are utilized. Therefore gravity is no longer sufficient in tilt mixers, in order to assure air flowing past the liquid. Depending on the diameter and the material of the vessel as well as the surface tension of the liquid, this is often even not achieved by inverting the vessel. Therefore mixers are used, which make possible a continuous tilting motion with simultaneous rotational motion of the specimens, so that forces higher than the own weight of the liquid are set up, which permit the air to flow past the liquid and result in the mixing of the media. The uncontrolled process is disadvantageous in the known mixers, meaning the specimen tubelets can be removed from the mixer or mixers at any time, so that a controlled mixing is not possible.

Vessels or containers of another type, namely cuvettes open on one side, which, in addition, have a very small, limited filling height, are known from the reference, DE 27 10 889 B2 to perform the mixing by means of a stepwise sequenced continuous rotation of the mixing cuvette around its longitudinal axis. The impulses resulting from the stepwise or stepped operation are to set the contents of the mixing cuvette in motion for mixing purposes and to accelerate the introduced components at the internal wall portions of the cuvette to a different degree. The disadvantages of the mixing cuvette are a specific shaping and/or additional structural items which have an effect of assisting the mixing, so as to improve the mixing result of the mixing cuvette rotating around its longitudinal axis. Additional design measures are therefore considered imperative for good intermixing and are thus accepted. Herein uncontrolled flows can be generated which do not assure a homogeneous intermixing.

In a device for mixing substances required in dentistry known from the U.S. Pat. No. 3,778,033, a mounting for vessel containers receiving the substances to be mixed is disposed so as to rotate around a vertical principal rotary axle. The container is supported on an auxiliary rotational axle provided in the mounting, which extends at an angle to the principal rotary axle, so that the container is disposed at an inclined position and is facing with its top end the main or principal rotary axle. In order to achieve a thorough intermixing, the principal rotary axle as well as the auxiliary rotary axle are power driven, and this indeed in opposite rotational directions. This embodiment requires considerable power for driving and is fraught in addition with a high expenditure of energy.

SUMMARY OF THE INVENTION

The invention is based upon the task of creating a method which permits rapid, gentle and thorough mixing of media of different weights contained in elongated specimen vessels, without the disadvantages enumerated above.

According to the present invention, this task is solved by rotating one or several containers intermittently around a rotary axle, with the container bottom end(s) circumscribing a circle having a smaller diameter than a circle circumscribed by the container top end(s), with the container being filled in such a way, that a sufficiently large empty space for mixing the specimen remains. The invention is based upon the finding confirmed by numerous tests, that a synergetic effect of centrifugal acceleration and gravity is set up due to the inclined position of the container or the containers and the intermittent rotation. This effect permits the mixing of media or substances homogeneously, and gently and thoroughly, without foam formation, and without involving the disadvantages stated in connection with the known mixers. The container or plurality of containers do not herein rotate around their longitudinal axis, rather they are disposed in receptacles connected to the axle of rotation and they rotate together with the central powered rotary axle.

The invention provides special advantages for mixing blood contained in elongated tubelets. Centrifugal force generated during the mixing process causes, together with the inclined position of the tubelets in this case, an upward migration of the heavy components of the blood (for instance erythrocytes or red blood corpuscles) up to the top end of the containers. During the intermittent rotary stops the medium (blood) slides downward or towards the bottom along the internal wall portions of the container. Herein the heavy erythrocytes fall, due to their higher density, more rapidly in the direction of the container bottom than the liquid substances and this results, within a short time, in a homogeneous mixture.

The vessels or containers used in the mixer for performing the inventive method, of which for reasons of symmetry, preferably at least two or an even number should be present, which then are disposed around, relative to the containers, the central common rotary axle. This means that said containers are disposed to rotate together with said central axle, and can be immediately placed in the desired inclined position into the appropriate receptacles of the mixer. Alternatively, receptacles can be configured in such a way that the tubelets are disposed in the mixer in a perpendicular position and they only tilt into the inclined position upon commencement of the rotary motion because of the centrifugal forces. The receptacle can furthermore be made in such a way, that the tubelets assume a perpendicular position if a low centrifugal force or none at all is present, for instance by means of a compression spring disposed in the receptacle, which acts upon the top container end.

The mixer determines which is the top and which is the bottom container end, wherein actually the bottom container end must always face the mixer pedestal.

As has been seen, a satisfactory intermixing can already be achieved after three or four cycles with an overall mixing duration of no more than approximately 12 seconds by a mixer operated in accordance with the inventive method. This mixer can also, if necessary, be combined with an analysis-or analytical-appliance. In the course of each cycle the mixer is operated with, for instance, an acceleration phase of 1 sec., running time with a maximum RPM of 1 sec. and a stoppage of 1 sec.; the coasting time amounts to approximately 1 sec.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
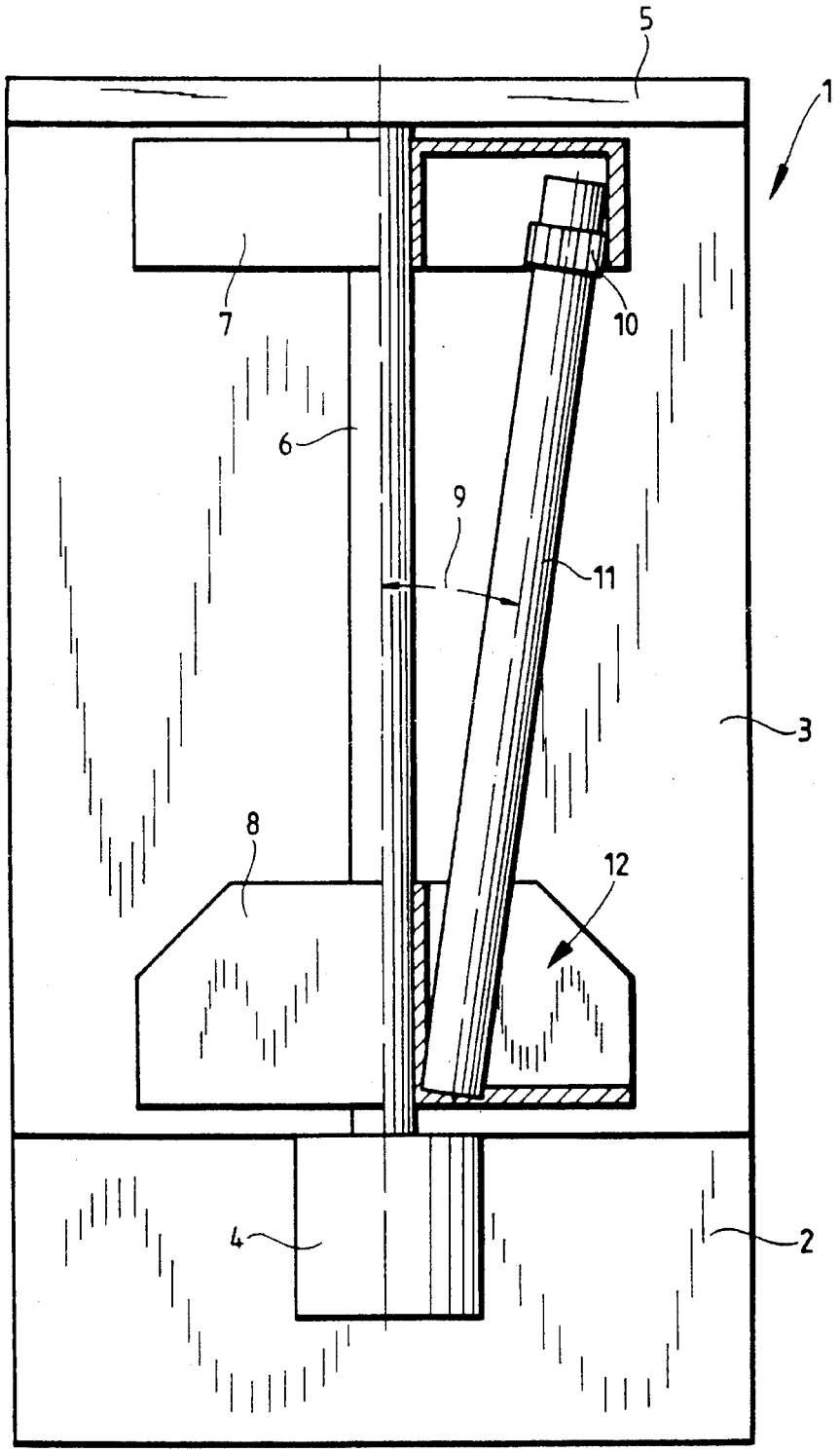
FIG. 1 is a front view of the present invention.

The features and advantages of the invention will become apparent from the following description, where an embodiment example of the object in the invention illustrated in FIG. 1, is described with particularity. The intermittent mixer shown in front view in the drawing has a pedestal 2 with a rear wall 3. A motor 4 is disposed in the pedestal which intermittently drives a rotary axle 6 supported on the one hand in the pedestal 2 and on the other hand in a web 5 bent at an angle off the rear part 3.

The rotary axle 6 comprises at its top end a rotating disk 7 and at its bottom end above the pedestal 2 a receiving rotor 8. An elongated specimen container 11 closed at its upper end by a seal 10 is inserted in an inclined position into a receiving rotor 8 rigidly connected to the rotary axle 6 and rotating together with same. This is indeed accomplished in such a way that the top container end rests in the rotating disk 7. The angle 9 between the container axis and the rotary axis amounts to approximately 7.5°. If the contents of only one specimen container 11 are to be intermixed, it is advisable to provide a balancing weight, for instance in the shape of a container, for reasons of symmetry or to dimension the pedestal 2 of the intermittent mixer 1 appropriately.

It lies within the framework of the invention to design the receptacles (rotating disk 7 and rotor 8) rigidly connected with the rotary axle 6 for the container or the plurality of specimen containers 11 in such a way, that the bottom container ends are located temporarily upon a smaller and temporarily upon a larger radius than the top container end (compare the seal 10). This is of assistance in that a higher force than gravity is exerted also during the reverse migration of the media, for instance blood from the top to the bottom and air from the bottom to the top, a circumstance which assures the intermixing, especially in very narrow containers or vessels.

In any case, the thorough gentle intermixing of the media or substances to be performed in the shortest time is always achieved in that, on the one hand, the centrifugal acceleration set up during rotation causes a favorable upward migration of the heavy substances accumulated in the bottom ends of the containers along the internal wall parts up to the upper end (seal 10) of the specimen container 11, this due to the discovered specific inclined position of the container, whose bottom end is spaced by a lesser amount from the rotary axle 6 than the upper end. On the other hand, gravity takes care of the downward sliding of the heavy substance along the internal wall parts of the specimen container in the direction towards the container bottom during the intermittent rotational stops and in the course of the decreasing rpm, so that the light and heavy substances are continuously thoroughly intermixed from the beginning of the mixing process.

While specific embodiments of the invention have been shown and described in detail to illustrate the application of the inventive principles, it will be understood that the invention may be embodied otherwise without departing from such principles.

What is claimed is:

1. Method for mixing a plurality of specimens having different specific weights in an intermittent mixer including a generally vertical central rotary axle, a drive motor means for intermittently rotating the rotary axle, and a receiving rotor which is integral with a bottom of the rotary axle, a top of the rotary axle being integral with a rotating disk, the rotating disk having a cavity defined by an outer wall located opposite the rotary axle, the method comprising the steps of:

filling at least one replaceable elongate container having top and bottom ends with the specimens such that the at least one container is partially filled with the specimens;

sealing the at least one container;

placing the at least one container in the intermittent mixer such that the bottom end of the at least one container contacts the receiving rotor while the top end of the at least one container contacts an inner surface of the outer wall of the rotating disk; and intermittently rotating the at least one container with the rotary axle while the at least one container is inclined such that a horizontal distance from the bottom end of the at least one container to the rotary axle is less than a distance from the top end of the at least one container to the rotary axle.

2. Method for mixing a plurality of specimens having different specific weights in an intermittent mixer including a generally vertical central rotary axle, a drive motor means for intermittently rotating the rotary axle, and a receiving rotor which is integral with a bottom of the rotary axle, a top of the axle being integral with a rotating disk, the rotating disk having a cavity defined by an outer wall located opposite the axle, the method comprising the steps of:

filling at least one elongate container having top and bottom ends with the specimens such that the at least one container is partially filled with the specimens;

sealing the at least one container;

placing the at least one container in the intermittent mixer such that the bottom end of the at least one container contacts the receiving rotor while the top end of the at least one container contacts an inner surface of the outer wall of the rotating disk; and intermittently rotating the at least one container with the rotary axle while the at least one container is inclined such that a horizontal distance from the bottom end of the at least one container to the rotary axle is less than a distance from the top end of the at least one container to the rotary axle, the angle between an axis of the at least one container and a vertical axis being approximately 7.5 degrees.

3. Method for mixing a plurality of specimens having different specific weights in an intermittent mixer including a generally vertical central rotary axle, a drive motor means for intermittently rotating the rotary axle, and a receiving rotor which is integral with a bottom of the rotary axle, the method comprising the steps of:

filling at least one replaceable elongate container having top and bottom ends with the specimens such that the at least one container is partially filled with the specimens;

sealing the at least one elongate container;

placing the at least one container in the intermittent mixer such that the bottom end of the at least one container contacts the receiving rotor, so that the at least one container is inclined, such that a horizontal distance between the bottom end of the at least one container to the rotary axle is less than a horizontal distance between the top end of the at least one container and the rotary axle; and intermittently rotating the rotary axle with the at least one container.

* * * * *